US010502501B1

(12) United States Patent
Roper et al.

(10) Patent No.: US 10,502,501 B1
(45) Date of Patent: Dec. 10, 2019

(54) LOUVERED ELLIPTICAL TUBE MICRO-LATTICE HEAT EXCHANGERS

(71) Applicant: HRL LABORATORIES, LLC, Malibu, CA (US)

(72) Inventors: Christopher S. Roper, Santa Monica, CA (US); Charles Kusuda, Mukilteo, WA (US); Arun Muley, San Pedro, CA (US); David Page, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 931 days.

(21) Appl. No.: 14/676,794

(22) Filed: Apr. 1, 2015

(51) Int. Cl.
*F28F 1/20* (2006.01)
*F28F 1/32* (2006.01)

(52) U.S. Cl.
CPC ..... *F28F 1/325* (2013.01)

(58) Field of Classification Search
CPC .... F28F 1/325; F28F 1/40; F28F 1/405; F28F 3/02; F28F 3/022; F28F 3/06; F28F 1/34; F28F 1/38; F28F 1/124; F28F 1/122
See application file for complete search history.

(56) References Cited

U.S. PATENT DOCUMENTS 5,425,414 A * 6/1995 Bradley, Jr. ..... F25D 17/067 165/150
8,573,289 B1 11/2013 Roper et al.
2005/0269069 A1* 12/2005 Hancock ..... F28D 1/0473 165/179
2012/0012292 A1* 1/2012 Bugler, III ..... F28D 5/02 165/174
2013/0143060 A1* 6/2013 Jacobsen ..... B29C 71/02 428/594
2016/0084578 A1* 3/2016 Kusuda ..... F28D 15/046 165/169

OTHER PUBLICATIONS

Hesselgreaves, J.E., Compact Heat Exchangers, Section, Design and Operation, Pergamon, Book, 2001, 11 pages.
CIPO Office Action for CA Patent Application No. 2,836,709, dated Feb. 10, 2015, 3 pages.
CIPO Office Action for CA Patent Application No. 2,836,709, dated Dec. 21, 2015, 3 pages.
EPO Examination and Search Report for EP Application No. 14157663.7, dated May 20, 2014, 5 pages.
EPO Examination Report for EP Application No. 14157663.7, dated Oct. 9, 2015, 4 pages.

(Continued)

*Primary Examiner* — Henry T Crenshaw
*Assistant Examiner* — Kamran Tavakoldavani
(74) *Attorney, Agent, or Firm* — Lewis Roca Rothgerber Christie, LLP

(57) ABSTRACT

A heat exchanger with non-circular tubes arranged in a louvered fashion. In one embodiment the tubes include a first plurality of hollow members extending in a first direction, a second plurality of hollow members extending in a second direction different from the first direction, and a third plurality of hollow members extending in a third direction different from the first direction and from the second direction, the hollow members of the first plurality of hollow members, the second plurality of hollow members, and the third plurality of hollow members intersecting at a plurality of hollow nodes.

20 Claims, 8 Drawing Sheets

(56) References Cited

OTHER PUBLICATIONS

USPTO Office Action for U.S. Appl. No. 13/785,973, dated Sep. 9, 2015, 9 pages.
USPTO Office Action for U.S. Appl. No. 13/785,973, dated Dec. 1, 2015, 15 pages.
U.S. Appl. No. 13/618,616, Roper et al.
U.S. Appl. No. 13/786,367, Maloney et al.
U.S. Appl. No. 14/185,665, Roper et al.
Maloney, K.J. et al., Multifunctional Heat Exchangers Derived from Three-Dimensional Micro-Lattice Structures, International Journal of Heat and Mass Transfer, 2012, 8 pages.
Roper, C.S. et al., Scalable Three-Dimensional Bicontinuous Fluidic Networks: Polymer Heat Exchanges and Towards Artificial Organs, Supporting Information, Mar. 5, 2015, 1 page.
Roper, C.S. et al., Scalable 3D Bicontinuous Fluid Networks: Polymer Heat Exchangers Toward Artificial Organs, Advanced Materials, Mar. 5, 2015, 6 pages.

* cited by examiner

LOUVERED ELLIPTICAL TUBE MICRO-LATTICE HEAT EXCHANGERS

CROSS-REFERENCE TO RELATED APPLICATION(S)

The present application is related to U.S. Pat. No. 7,382,959, entitled "OPTICALLY ORIENTED THREE-DIMENSIONAL POLYMER MICROSTRUCTURES" (the "'959 Patent"), U.S. Pat. No. 8,573,289, entitled "MICRO-ARCHITECTED MATERIALS FOR HEAT EXCHANGER APPLICATIONS" (the "'289 Patent"), U.S. application Ser. No. 13/618,616 filed Sep. 14, 2012, entitled "HOLLOW POLYMER MICRO-TRUSS STRUCTURES CONTAINING PRESSURIZED FLUIDS" (the "'616 Application"), U.S. application Ser. No. 13/786,367, filed Mar. 5, 2013, entitled "HOLLOW POROUS MATERIALS WITH ARCHITECTED FLUID INTERFACES FOR REDUCED OVERALL PRESSURE LOSS" (the "'367 Application"), and U.S. application Ser. No. 14/185,665, filed Feb. 20, 2014; entitled "HEAT EXCHANGERS MADE FROM ADDITIVELY MANUFACTURED SACRIFICIAL TEMPLATES" (the "'665 Application"), the entire content of each of which is incorporated herein by reference.

BACKGROUND

1. Field

One or more aspects of embodiments according to the present invention relate to heat exchangers, and more particularly to heat exchangers including tubes with elongated cross sections, arranged in a louvered fashion.

2. Description of Related Art

Heat exchangers are used in numerous applications, including cooling or heating of structures or vehicles, cooling of engines or other machinery, and cooling of fluids for chemical production or power generation. Heat exchangers are used to transfer heat from one fluid to another, cooler fluid. One or both fluids may be pumped through the heat exchanger. Several characteristics may be desirable in a heat exchanger, including, for a given rate of heat transfer, small mass and volume, and low pumping power. Thus, there is a need for a heat exchanger to provide a high heat transfer rate in a small volume, and/or to require low pumping power for one or both fluids.

SUMMARY

Aspects of embodiments of the present disclosure are directed toward a heat exchanger with non-circular tubes arranged in a louvered fashion. In one embodiment the tubes include a first plurality of hollow members extending in a first direction, a second plurality of hollow members extending in a second direction different from the first direction, and a third plurality of hollow members extending in a third direction different from the first direction and from the second direction, the hollow members of the first plurality of hollow members, the second plurality of hollow members, and the third plurality of hollow members intersecting at a plurality of hollow nodes.

According to an embodiment of the present invention there is provided a heat exchanger, including a heat exchanger core including: a first plurality of hollow members extending in a first direction; and a second plurality of hollow members extending in a second direction different from the first direction; the hollow members of the first plurality of hollow members, and the second plurality of hollow members intersecting at a plurality of hollow nodes, each hollow member of the first plurality of hollow members, and the second plurality of hollow members having: a longitudinal axis, and at a point along the longitudinal axis, an elongated cross section in a plane perpendicular to the longitudinal axis, the cross section including a minor axis and a major axis, the major axis being at least 20 percent longer than the minor axis, the major axis of a first hollow member of the first plurality of hollow members extending in a different direction from the major axis of a second hollow member of the first plurality of hollow members.

In one embodiment, the heat exchanger core further includes a third plurality of hollow members extending in a third direction different from the first direction and from the second direction; the hollow members of the first plurality of hollow members, the second plurality of hollow members, and the third plurality of hollow members intersecting at the plurality of hollow nodes each hollow member of the third plurality of hollow members having: a longitudinal axis, and at a point along the longitudinal axis, an elongated cross section in a plane perpendicular to the longitudinal axis, the cross section including a minor axis and a major axis, the major axis being at least 20 percent longer than the minor axis.

In one embodiment, the elongated cross section of each hollow member of the first plurality of hollow members, the second plurality of hollow members, is an elliptical cross section.

In one embodiment, the elongated cross section of each hollow member of the first plurality of hollow members, the second plurality of hollow members, has a shape of an airfoil.

In one embodiment, the elongated cross section of each hollow member of the first plurality of hollow members, the second plurality of hollow members is a rectangular cross section with rounded corners.

In one embodiment, the heat exchanger includes an inlet and an outlet and having a principal external flow direction substantially parallel to a line from the inlet to the outlet, wherein the core includes: a first region including hollow members of the first plurality of hollow members; a second region including hollow members of the second plurality of hollow members; and a third region including hollow members of the third plurality of hollow members, the second region being between the first region and the third region and wherein the major axis of each hollow member of the first region is substantially parallel to the principal external flow direction, the major axis of each hollow member of the second region is oblique to the principal external flow direction, and the major axis of each hollow member of the third region is substantially parallel to the principal external flow direction.

In one embodiment, the heat exchanger includes an inlet and an outlet and having a principal external flow direction substantially parallel to a line from the inlet to the outlet, wherein the core includes: a first region including hollow members of the first plurality of hollow members; a second region including hollow members of the second plurality of hollow members; and a third region including hollow members of the third plurality of hollow members, the second region being between the first region and the third region, and wherein the major axis of each hollow member of the first region is oblique to the principal external flow direction, the major axis of each hollow member of the second region is substantially parallel to the principal external flow direction, and the major axis of each hollow member of the third region is oblique to the principal external flow direction.

In one embodiment, the angle between the major axis of a hollow member of the first region and the principal external flow direction has substantially the same magnitude as the angle between the major axis of a hollow member of the third region and the principal external flow direction.

In one embodiment, the heat exchanger includes an interior volume of each of: the first plurality of hollow members; the second plurality of hollow members; and the plurality of hollow nodes; a first surface, the first surface being substantially flat; and a second surface, the second surface being substantially flat and substantially parallel to the first surface, the heat exchanger further including a first tubesheet and a second tubesheet, each of the first tubesheet and the second tubesheet having a respective plurality of perforations in fluid communication with the interior core volume.

In one embodiment, a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of: a fifth plurality of hollow members being nearer than the first node to the first surface; and a sixth plurality of hollow members being nearer than the first node to the second surface; a cross sectional area of the first hollow node being substantially equal to the sum of cross sectional areas of the fifth plurality of hollow members.

In one embodiment, a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of: a fifth plurality of hollow members being nearer than the first node to the first surface; and a sixth plurality of hollow members being nearer than the first node to the second surface; a cross sectional area of the first hollow node being within 15% of the sum of cross sectional areas of the fifth plurality of hollow members.

In one embodiment, a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of: a fifth plurality of hollow members being nearer than the first node to the first surface; and a sixth plurality of hollow members being nearer than the first node to the second surface; a cross sectional area of the first hollow node being substantially equal to the greater of: the sum of cross sectional areas of the fifth plurality of hollow members and the sum of cross sectional areas of the sixth plurality of hollow members.

In one embodiment, a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of: a fifth plurality of hollow members being nearer than the first node to the first surface; and a sixth plurality of hollow members being nearer than the first node to the second surface; a cross sectional area of the first hollow node being within 15% of the greater of: the sum of cross sectional areas of the fifth plurality of hollow members and the sum of cross sectional areas of the sixth plurality of hollow members.

In one embodiment, the hollow members of the first plurality of hollow members and the second plurality of hollow members include a plurality of dimples.

In one embodiment, each of the dimples of the plurality of dimples has a non-circular cross section, taken on a plane substantially tangent to a wall of a hollow member at the dimple.

In one embodiment, the cross section of each of the dimples of the plurality of dimples, taken on a plane substantially tangent to a wall of a hollow member at the dimple, has a major axis, and the major axis of the cross section of a first dimple of the plurality of dimples is oblique to the major axis of the cross section of a second dimple of the plurality of dimples.

In one embodiment, a set of nodes of the plurality of nodes falls substantially in a plane, and wherein a spacing between centers of adjacent nodes in a first direction in the plane is at least 30% greater than a spacing between centers of adjacent nodes in a second direction, perpendicular to the first direction, in the plane.

In one embodiment, the major axis of the first hollow member is oblique to the major axis of the second hollow member.

In one embodiment, the major axis of the first hollow member is perpendicular to the major axis of the second hollow member.

BRIEF DESCRIPTION OF THE DRAWINGS

These and other features and advantages of the present invention will be appreciated and understood with reference to the specification, claims and appended drawings wherein:

FIG. 8B is a top view of a top set of rows of the heat exchanger of FIG. 8A according to an embodiment of the present invention;

FIG. 8C is a top view of a an upper middle set of rows of the heat exchanger of FIG. 8A according to an embodiment of the present invention;

FIG. 8D is a top view of a lower middle set of rows of the heat exchanger of FIG. 8A according to an embodiment of the present invention; and FIG. 8E is a top view of a bottom set of rows of the heat exchanger of FIG. 8A according to an embodiment of the present invention.

DETAILED DESCRIPTION

Figure 1:
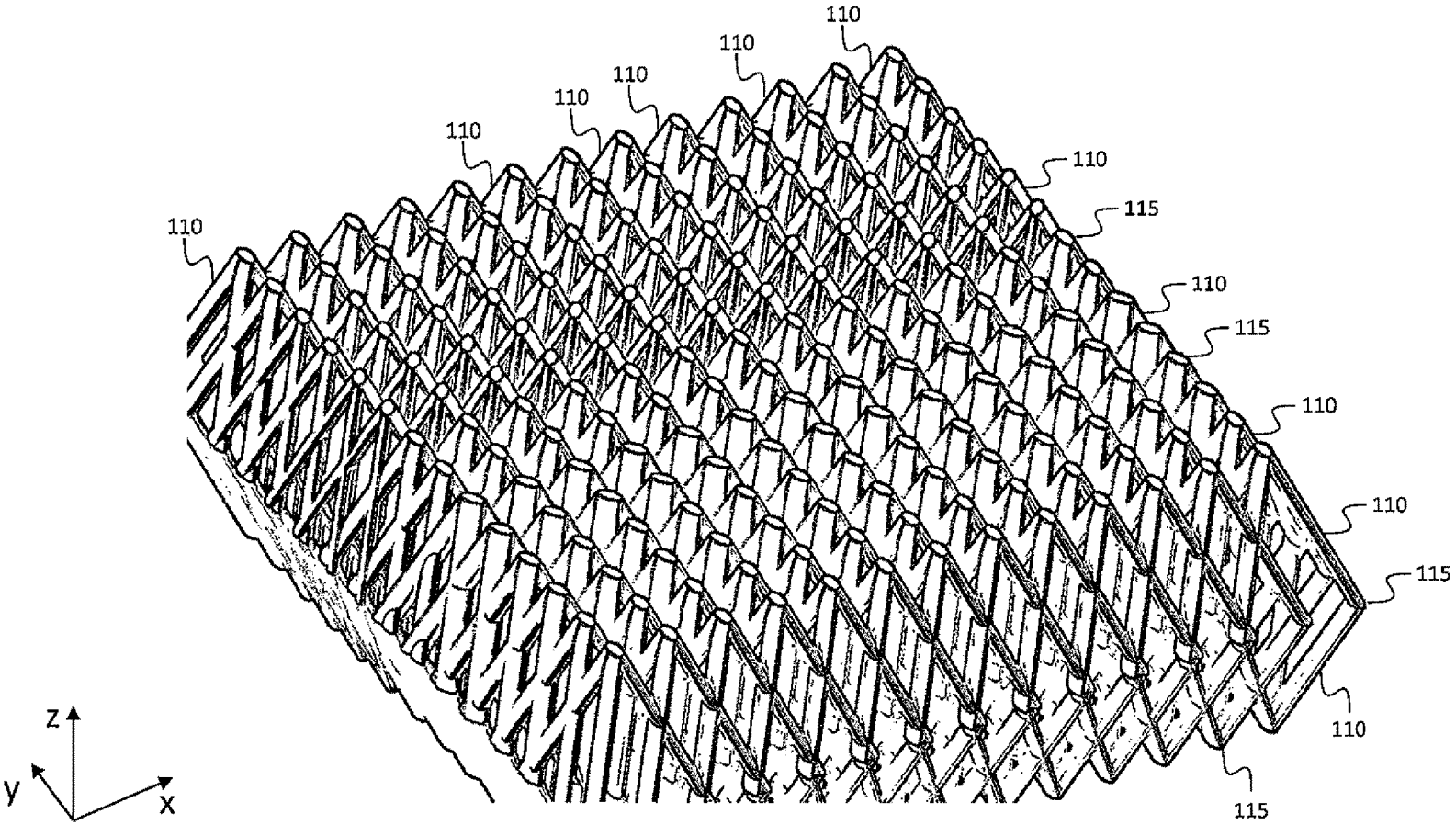
FIG. 1 is a perspective view of a heat exchanger core according to an embodiment of the present invention.

The detailed description set forth below in connection with the appended drawings is intended as a description of exemplary embodiments of a louvered elliptical tube micro-lattice heat exchanger provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Embodiments of this invention transport an increased or maximum amount of heat from one fluid stream to another fluid stream with minimal pumping power expended to drive the fluid flow. Related art plate-fin heat exchangers require high thermal conductivity materials (e.g. aluminum or copper) to have high fin efficiency and thus high effectiveness. Furthermore, microchannel and minichannel shell-and-tube heat exchangers may be unable to or have greater difficulty supporting mechanical loads (e.g. shear, tension, and compression) in various or all directions.

Micro-truss or "micro-lattice" heat exchangers as disclosed in the '289 patent may be fabricated utilizing a micro-lattice (as disclosed in the '959 Patent) as a sacrificial scaffold. The micro-lattice scaffold is conformal coated with the material used to form the heat exchanger walls and the scaffold is removed, leaving a hollow micro-truss. Micro-truss heat exchangers show promise for reduced system weight, especially through multifunctionality (e.g. adding energy absorption functionality to a heat exchanger). Embodiments of the present invention improve the traditional micro-truss geometry and result in much lower pressure drop than that seen with traditional micro-truss geometry (especially those applications involving flow of a gas), and thus more efficient heat exchangers. In some embodiments louvered elliptical tubes or hollow micro-truss members enhance heat transfer in micro-truss heat exchangers.

Micro-lattice heat exchangers may not rely on extended surface heat transfer, enabling the heat exchanger materials to be chosen for requirements other than high thermal conductivity, such as high temperature stability, high stiffness, high strength, and/or low density/light weight. Additionally, a micro-lattice heat exchanger includes an interconnected network of hollow tubes, which may enable it to support mechanical loads (e.g. shear, tension, and/or compression) in various or all directions.

Micro-lattice heat exchangers with features including varied tube cross sections, rectangular arrays of hollow micro-truss members, and reduced or minimal change in the cross-sectional area of the nodes, have resulted in significant performance gains (including large reductions in internal pressure loss) compared to micro-lattice heat exchangers with circular cross sections, square arrays of hollow micro-truss members, and significant constrictions at the nodes. Louvered elliptical heat exchangers add another layer of architecture, the individual orientation of each elliptical tube, thus enabling further increases in performance.

Referring to FIG. 1, in one embodiment, a hollow micro-truss heat exchanger has a core composed of a plurality of hollow truss members, or "truss members", or "hollow members" 110 interpenetrating at a plurality of hollow nodes 115. The nodes are arranged into periodic planes, each of which has a periodic arrangement of nodes, e.g., the nodes form a repeating pattern on each plane. In a micro-truss heat exchanger, a first fluid, the "internal" fluid, flows within the internal volume, or "internal fluid volume", i.e., within the hollow truss members and through the hollow nodes, and a second fluid, the "external" fluid, flows within the external volume, or "external fluid volume", i.e., around the exterior of the hollow truss members and of the hollow nodes. Heat is transferred between the two fluids, which are not in fluid communication.

In one embodiment the heat exchanger core is in the shape of a sheet, as illustrated in FIG. 1, the plane of the sheet being perpendicular to a z axis as shown, and the internal flow is from the top of the sheet to the bottom of the sheet or from the bottom of the sheet to the top of the sheet, with a mean internal flow velocity, averaged over the core, substantially parallel to the z axis. The external fluid flows primarily in a principal external flow direction (e.g., the z-direction in FIG. 3) which is from an external flow inlet to an external flow outlet (e.g., from inlet 850 to outlet 855 in FIG. 8). The external flow deviates from this direction in some places, e.g., where the external fluid flows around a truss member, or where the external flow may be deflected by a truss member having an angled elongated cross section.

Figure 2A:
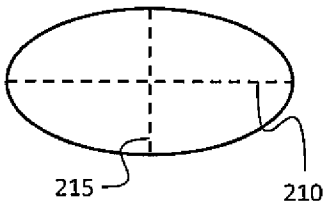
FIG. 2A is a cross-sectional view of a hollow truss member having an elliptical cross section according to an embodiment of the present invention.
Figure 2B:
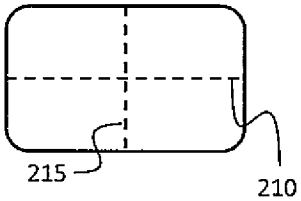
FIG. 2B is a cross-sectional view of a hollow truss member having a rectangular cross section with rounded corners according to an embodiment of the present invention.

Each truss member may have a cross section that is not circular, e.g., the cross section may be elongated. The cross section of the truss member may be elliptical (FIG. 2A), or rectangular with rounded corners (FIGS. 2B and 2C), or it may have the shape of an airfoil (FIG. 2D). If the heat exchanger core is fabricated from a template that is a micro-lattice (as disclosed in the '959 Patent), then a mask having apertures with a shape that, when projected onto a plane perpendicular to a truss member, is the cross-section of the truss member, may be used.

Figure 2C:
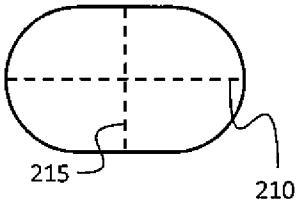
FIG. 2C is a cross-sectional view of a hollow truss member having a rectangular cross section with rounded corners according to another embodiment of the present invention.
Figure 2D:
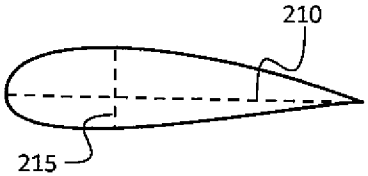
FIG. 2D is a cross-sectional view of a hollow truss member having a cross section in the shape of an airfoil according to an embodiment of the present invention.

In the case of a cross section that is rectangular with rounded corners, if the radius of curvature of the corners is sufficiently large, the cross section may consist of two semi-circular portions and two straight portions, as illustrated in FIG. 2C. In one embodiment the cross section of the hollow truss members is different in one part of the heat exchanger from the cross section of the hollow truss members in another part of the heat exchanger. As used herein, the "cross section" of a truss member is taken at a cutting plane perpendicular to a longitudinal axis of the truss member, where the longitudinal axis is parallel to the longest (or largest) dimension of the truss member, or, equivalently, the longitudinal axis is parallel to a line drawn between the two nodes at the two ends of the truss member (e.g., the longitudinal axis is parallel to a length of the truss member). An elongated cross section has a major axis 210, in the direction of the largest dimension (e.g., the largest diameter) of the cross section, and a minor axis 215 perpendicular to the major axis and in the direction of the smallest dimension (e.g., the smallest diameter) of the cross section. Each truss member thus defines a longitudinal axis (e.g., a length in the longitudinal axis), and a major axis and a minor axis (the major axis and minor axis, respectively, of the cross section of the truss member). The elongated cross sections may improve the heat transfer rate per unit pumping power through several mechanisms, e.g., the elongated cross sections may have greater surface area for heat transfer, they may provide higher Nusselt numbers, and they may provide a reduced resistance to the flow of the external fluid.

Figure 3:
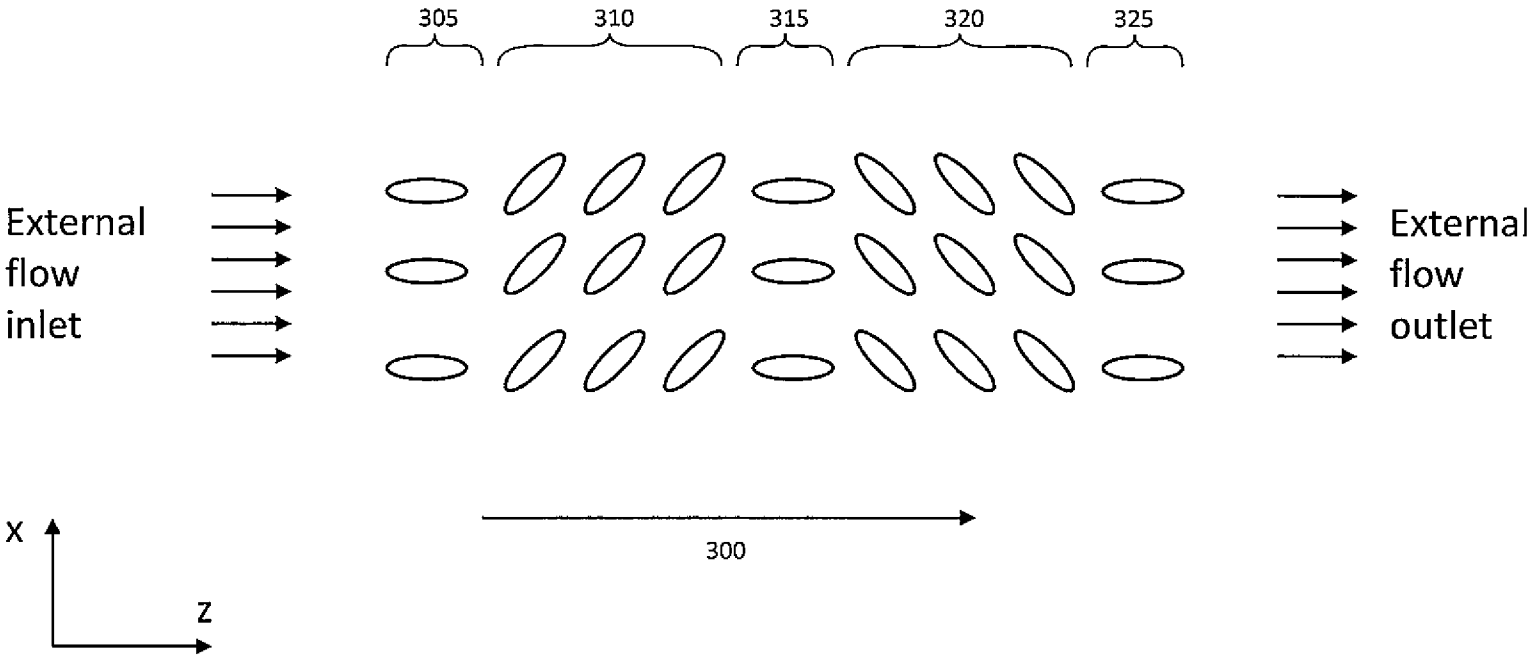
FIG. 3 is an illustration of cross sections of hollow truss members with orientations that differ in different regions of a heat exchanger core according to an embodiment of the present invention.

FIG. 3 illustrates the orientations of the major axes, in one embodiment, of truss members in a micro-truss heat exchanger in which each truss member has an elliptical cross section. In one embodiment, the truss members have elongated cross sections having major axes the direction of which varies along the principal external flow direction 300. The flow of the external fluid may locally align preferentially with and/or be biased toward a direction parallel to the longer axis, and, in the embodiment of FIG. 3, at each point along the external flow direction, a set of elongated truss members acts as a louver, directing the local external flow, alternately up or down, or in the principal external flow direction, causing the external fluid to flow along an undulating path, making one or more wavy excursions from the principal external flow direction 300. The truss members of the embodiment of FIG. 3 form five regions: a first region 305, a third region 315, and a fifth region 325 in each of which the major axis of each hollow truss member is substantially parallel to the principal external flow direction, and a second region 310 and a fourth region 320, in each of which the major axis of each hollow truss member is oblique to the principal external flow direction. In one embodiment the truss member cross sections are elliptical and louvered up in the second region 310 (i.e., the projection of the major axis onto the x-y plane falls in the first and third quadrants of the x-y plane), so that the axis of a hollow truss member of the second region 310 forms a first angle with the principal external flow direction, and louvered down in the fourth region 320 (i.e., the projection of the major axis onto the x-y plane falls in the second and fourth quadrants of the x-y plane) so that the axis of a hollow member of the fourth region 320 forms a second angle with the principal external flow direction. The signs of the first and second angles may be opposite (e.g., one being +30° and the other being −30°) and the first angle may have substantially the same magnitude as the second angle (e.g., both magnitudes being 30°).

The angle between the principal external flow direction and the major axis or axes of one or more of the hollow truss members to achieve this effect may be between 5 degrees and 45 degrees. In one embodiment the angle is between 12 and 30 degrees. The pattern of orientations of the major axis or axes of one or more of the hollow truss members may be chosen to eliminate "dead zones" or regions of low heat transfer between adjacent hollow truss members in the primary flow direction, to impinge flow on the sides of tube walls, to break up the boundary layers, or to eliminate local hot spots or cold spots in the heat exchanger.

Figure 4A:
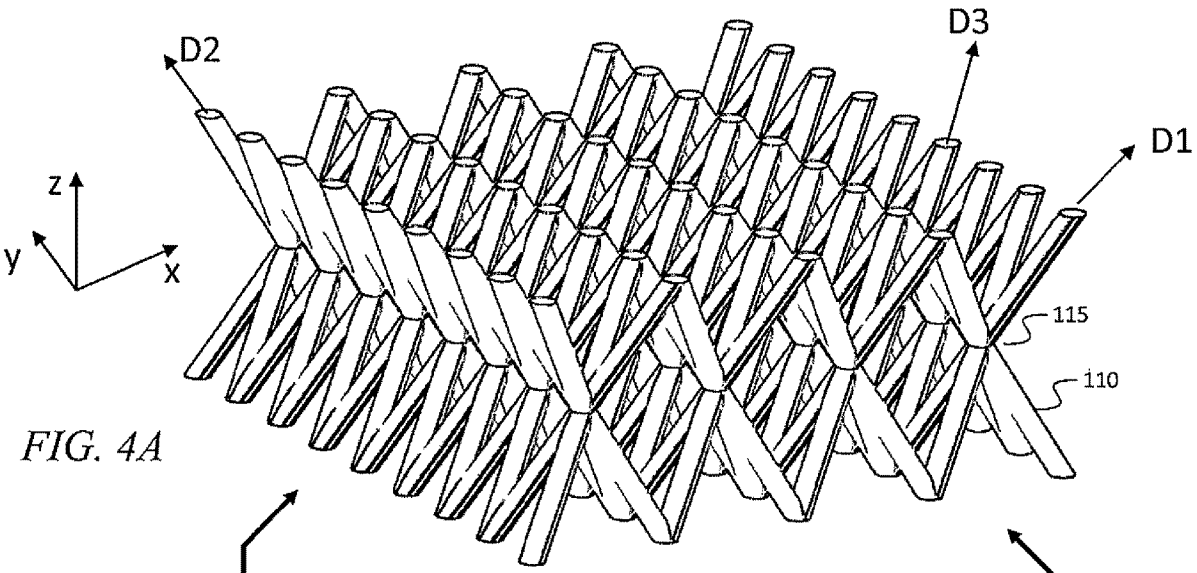
FIG. 4A is a perspective view of a heat exchanger core with rectangular node spacing according to an embodiment of the present invention.
Figure 4C:
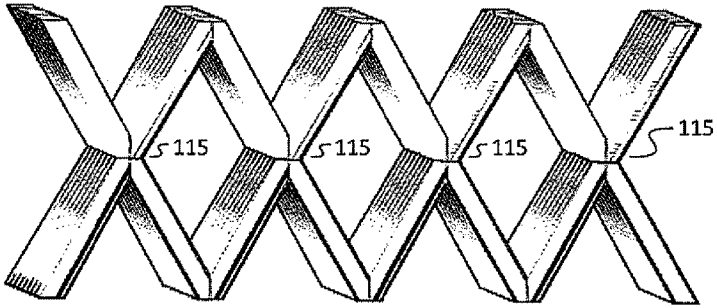
FIG. 4C is a perspective view of part of the heat exchanger core of according to an embodiment.
Figure 4B:
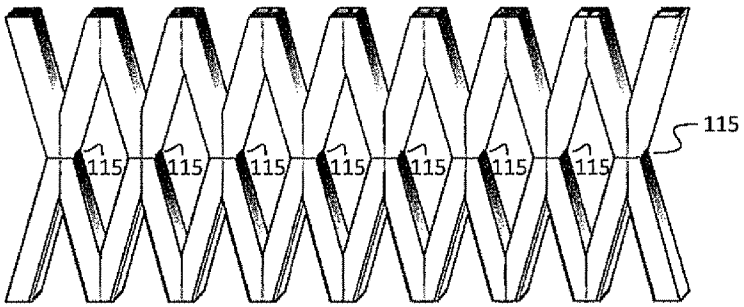
FIG. 4B is a perspective view of part of the heat exchanger core according to an embodiment.

In some embodiments, referring to FIGS. 4A-4C, a set of nodes in a plane parallel to the x-y plane may be arranged in a rectangular spacing, e.g., the node spacing in the x direction may be greater or less than the node spacing in the y direction. FIG. 4A illustrates a version of this arrangement. FIG. 4A shows a first plurality of hollow members extending in a first direction D1, a second plurality of hollow members extending in a second direction D2 different from the first direction D1, and a third plurality of hollow members extending in a third direction D3 different from the first direction D1 and from the second direction D2. In one embodiment the first, second, and third directions (and the corresponding hollow members) are not coplanar. The angle between any pair of the first direction D1, the first direction D2, and the third direction D3 may be acute, obtuse, or a right angle. FIG. 4B illustrates the perceived node spacing along the y axis of the heat exchanger core of FIG. 4A when viewed nearly along the x axis. FIG. 4C illustrates the perceived node spacing along the x axis of the heat exchanger core of FIG. 4A when viewed nearly along the y axis.

In one embodiment, a heat exchange core may be formed of flat hollow micro-trusses, arranged in a stack. In this embodiment each flat hollow micro-truss may include a first plurality of hollow truss members extending in a first direction (e.g., D1) and a second plurality of hollow truss members extending in a second direction (e.g., D2) different from the first direction. There may be a space between adjacent layers of the stack.

Figures 5A, 5B:
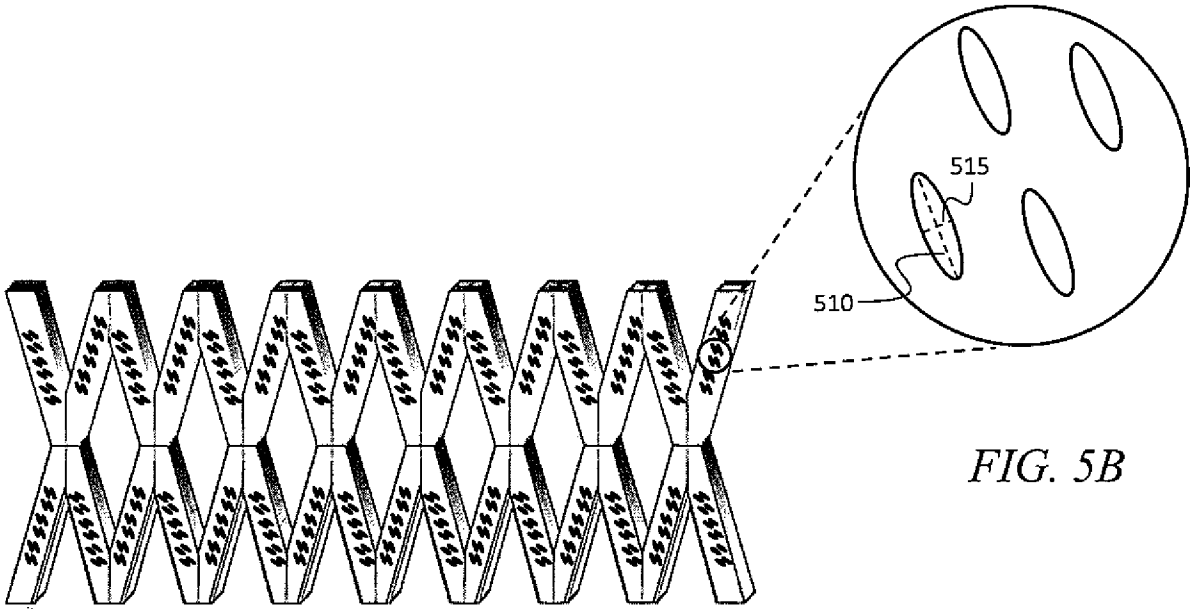
FIG. 5A is a side view of a heat exchanger core having hollow truss members with dimples according to an embodiment of the present invention.
FIG. 5B is an enlarged view of a portion of a hollow truss member of the heat exchanger core of FIG. 5A.

Referring to FIGS. 5A and 5B, in one embodiment, the hollow truss members may have dimples, which may increase the surface area and disrupt the boundary layer around each of the hollow truss members. Each dimple may have a major axis 510 and a minor axis 515 as illustrated in FIG. 5B.

In some embodiments some or all of the hollow nodes have an elongated cross section, which, like the hollow truss members (illustrated in FIGS. 2A-2D), may be elliptical, rectangular, rectangular with rounded corners, or in the shape of an airfoil. The cross sections need not be the same throughout the heat exchanger, and multiple cross sections may be used. The cross section of each node may have a major axis, in the direction of the largest dimension of the cross section, and a minor axis perpendicular to the major axis; this may result in the local external flow aligning preferentially with the major axis of the nodes nearby. Like the orientations of the major axes of the hollow truss members illustrated in FIG. 3, the orientations of the major axes of the hollow nodes may also be configured as shown in FIG. 3, e.g., the pattern of node orientations may be designed to move flow in the external fluid volume in a pattern other than straight through the heat exchanger, e.g., the pattern may move the fluid flow along an undulating path, with the primary direction being aligned with the path straight through the heat exchanger (e.g., parallel to the principal external flow direction) and with one or more wavy excursions from this path.

The angle between the principal external flow direction and the major axis or axes of one or more of the hollow nodes may be between 5 degrees and 45 degrees. In one embodiment the angle is between 12 and 30 degrees. The pattern of orientations of the major axis or axes of one or more of the hollow nodes may be chosen to eliminate "dead zones" or regions of low heat transfer between adjacent hollow micro-truss members in the primary flow direction, to impinge flow on the sides of tube walls, to break up the boundary layers, or to eliminate local hot spots or cold spots in the heat exchanger.

Figure 6:
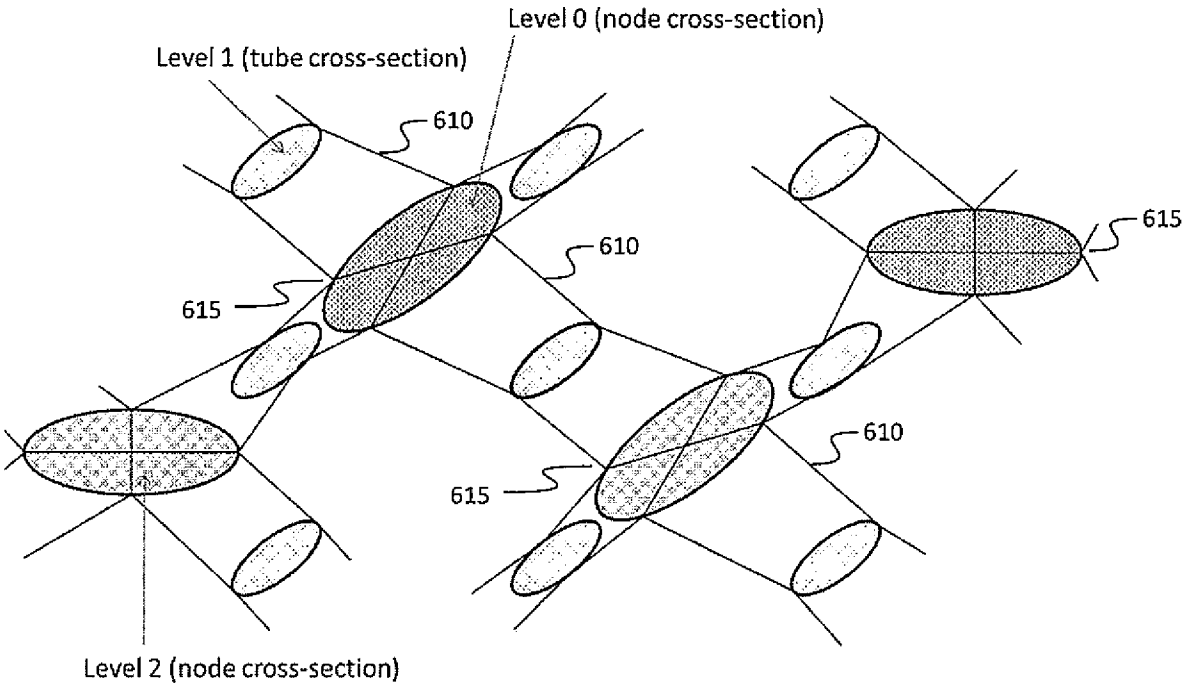
FIG. 6 is a side view of a heat exchanger core having tapered hollow truss members and enhanced-cross-section nodes according to an embodiment of the present invention.
Figure 7:
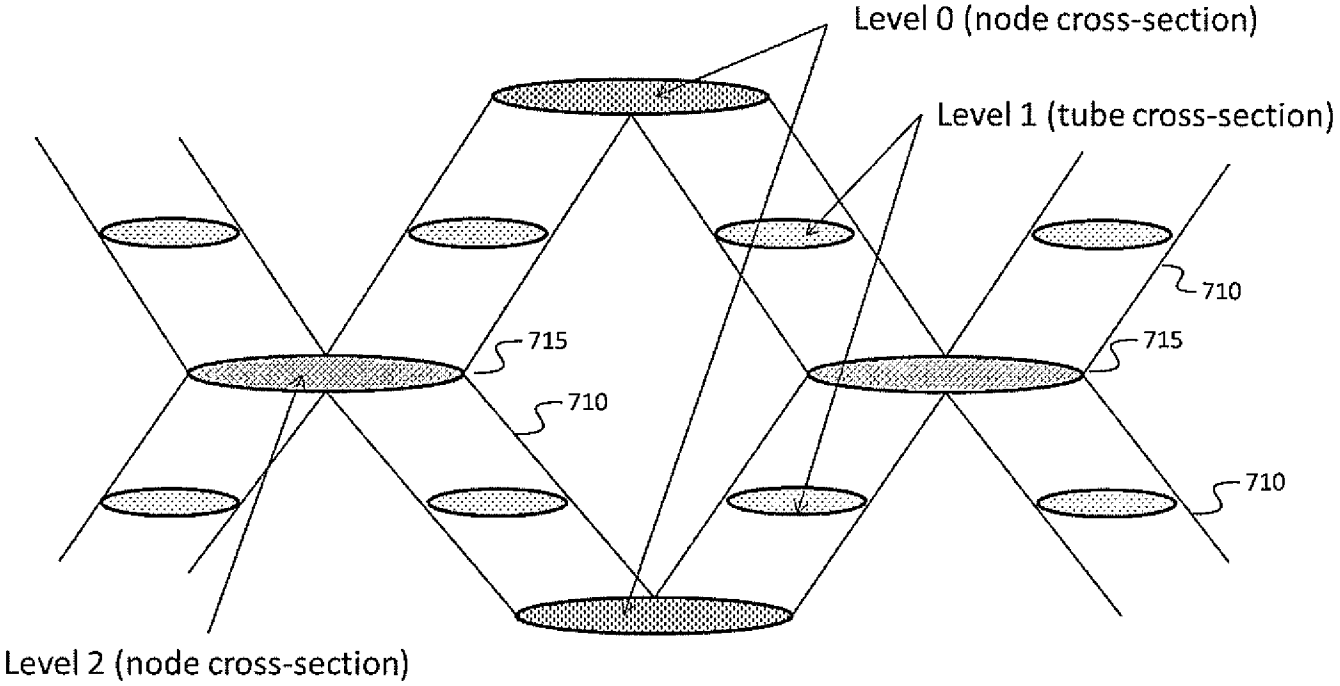
FIG. 7 is a side view of a heat exchanger core having offset hollow truss members and enhanced-cross-section nodes according to an embodiment of the present invention.

If the cross sectional area of the nodes is the same as that of the hollow members, the nodes may restrict the internal flow, if the fluid flowing through two or more hollow members must fit through a node having the same cross-sectional area as one of the hollow members. Thus, in one embodiment the cross-sectional area of the nodes may be greater than the cross-sectional area of the truss members. This may help to reduce pressure drop at the nodes. Referring to FIGS. 6 and 7, in one embodiment, the truss members 610 are tapered near the nodes 615 (FIG. 6), or the truss members 710 have an offset (FIG. 7) at the nodes 715, resulting in nodes 615, 715 with greater cross-sectional area. In one embodiment the cross sectional area of a given node is equal to (or at least within 15% of) the sum of the cross-sectional areas of the hollow micro-truss members which bring fluid to the node, or the cross sectional area of a given node is equal to (or at least within 15% of) the sum of the cross-sectional areas of the hollow micro-truss members which remove fluid from the node. The number of truss members that bring fluid to the node, or their cross sectional areas, may differ from the number or cross sectional areas of the truss members that remove fluid from the node. In one embodiment the cross sectional area of a given node is equal to (or at least within 15% of) the greater of (i) the sum of the cross-sectional areas of the hollow micro-truss members which bring fluid to the node and (ii) the sum of the cross-sectional areas of the hollow micro-truss members which remove fluid from the node.

The structures illustrated in FIGS. 1, 4, 5, and 7 are only one unit cell high; in each case this size of structure is depicted for ease of visualizing the architecture. In other embodiments the heat exchanger core is in the shape of a thicker sheet, which may be composed of several sheets, or of a large number of sheets such as the ones illustrated in FIG. 1, 4, 5, or 7, stacked to form a heat exchanger core in the shape of a thicker sheet, or a heat exchanger core in the shape of a block.

Figure 8A:
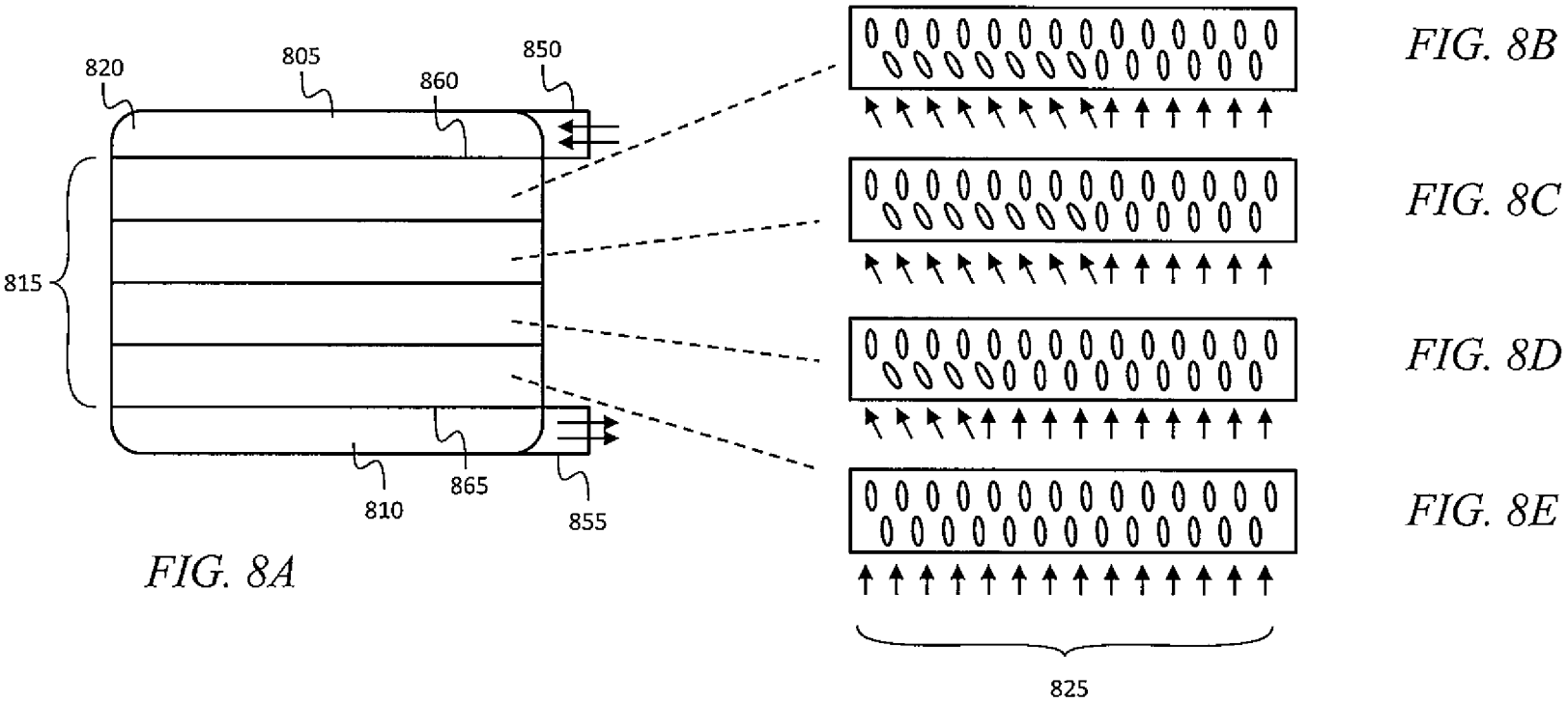
FIG. 8A is a side view of a heat exchanger according to an embodiment of the present invention.

In one embodiment the heat exchanger includes one or more manifolds 805, 810 (FIG. 8A) each of which may include an internal flow inlet and/or outlet tubesheet 860, 865 (FIG. 8A). The tubesheet is a perforated sheet having a hole or perforation corresponding to each open connection (e.g., an open end of a truss member or an open node) in the inlet or outlet surface of the heat exchanger core. The tubesheet is secured to the inlet or outlet surface of the heat exchanger core and each perforation is sealed to the corresponding open connection of the heat exchanger core. In the embodiment, each hole or perforation of the tubesheet is in fluid communication with the internal volume and not with the external volume; thus the tubesheet allows flow to be guided into only the internal volume. Other and/or external surfaces of the tubesheet may form a part of the external volume or a volume that is in fluid communication with the external volume. Similarly the internal flow outlet tubesheet connects to either a subset of the hollow micro-truss members or a subset of the hollow nodes, and the internal flow outlet tubesheet collects flow from only the internal fluid volume. The tubesheets may be connected to headers, thus forming internal flow inlet and outlet manifolds, which may be added for the inlet and outlet of the external flow. Sheets may also be added to block external flow where it is not desired. The heat exchanger may be fabricated from one material or multiple materials, including polymers (e.g. parylene-N, parylene-C, parylene-AF-4, ABS, etc.), metals and metal alloys (e.g. aluminum alloys, titanium and titanium alloys, etc.), ceramics (e.g. silicon carbide, etc.), composites, and combination of the above (e.g. in lamellae; with particles of one material dispersed in a matrix of another material; etc.). The transitions between the tubesheets and the hollow micro-truss members or the tubesheets and the nodes may be tailored for reduced pressure drop as disclosed in the '367 Application. The hollow micro-truss members may have features such as interior or exterior dimples or indents so as to form exterior or interior mounds, tabs, or triangular projections on the surfaces of the hollow micro-truss members. The features may promote fluid mixing and hence the heat transfer enhancement. The tabs or dimples may have elliptical cross-sections, taken on a plane substantially tangent to the wall of the hollow member at the dimple. The dimples may form louvers. The tabs or dimples may have a louver orientation separate from the hollow micro-truss louver orientation. Fluids flowing in the internal or external volumes of the heat exchanger core may be air or other fluids, and may be compressible or incompressible fluids.

Referring to FIG. 8A, in one embodiment a heat exchanger has a hot supply manifold 805 supplying hot fluid to the internal volume of the heat exchanger core 815, and a cool return manifold 810. Hot spots, or higher temperature regions may form where greater concentrations of hot flows occur, as in the end 820 of a hot supply manifold where dynamic pressure is converted to static pressure resulting in locally increased hot mass flows down through the core. To reduce the temperature gradient across the heat exchanger core, increased flows of cold fluid (e.g., cold air) in the areas of increased hot fluid (e.g., hot air) flows may result in increased heat transfer, and lower temperatures. In one embodiment louvered truss members and louvered nodes directing more cold fluid flows into the localized areas of the higher hot fluid flows accomplish these intended results. FIGS. 8B-8D illustrate how louvers formed by tilted elongated hollow members may direct the flow of cold fluid 825 in the external volume toward the hot spot 820. In the embodiment of FIGS. 8A-8D, FIGS. 8B-8D are cross sections of FIG. 8A, taken along horizontal cutting planes extending into and out of the paper, i.e., cutting planes perpendicular to the vertical direction of FIG. 8A. In the embodiment of FIGS. 8A-8D, the direction of flow of cold fluid is into the into the paper in FIG. 8A (and up in FIGS. 8B-8D). A structure similar to that of FIG. 1 may be used in the embodiment of FIGS. 8A-8D, with the z-axis of the structures being vertical in FIG. 8A, and with the external dimensions of the structure adjusted so that the structure is short in the y direction, and long in the x and z directions.

Several methods may be used to fabricate heat exchangers according to embodiments of the present invention. In one embodiment, examples of which are disclosed in the '367 Application, a sacrificial scaffold is formed by first forming a micro-truss. Facesheets may be formed on the sacrificial scaffold, and the micro-truss, with the facesheets if they are present, is coated with a coating material. The sacrificial scaffold is then removed, leaving a hollow micro-truss composed of the coating material and, if facesheets were used, tubesheets composed of the coating material, secured and sealed to the hollow micro-truss. FIGS. 4A and 4B of the '367 Application illustrate the formation of tubesheets on the interior surfaces of two facesheets, which are then, removed, leaving the tubesheets and the hollow micro-truss. A hollow micro-truss having hollow micro-truss members with elongated (i.e., non-circular) cross sections may be formed by using a mask with elongated (i.e., non-circular) holes when illuminating a photopolymerizable resin through the mask to form the sacrificial micro-truss scaffold, as disclosed in the '959 Patent. Each elongated hole may have an orientation designed to correspond to the desired orientations of the hollow micro-truss members in the heat exchanger. The orientations of the individual hollow micro-truss members cross sections may vary in a 2-dimensional array across the micro-truss heat exchanger core.

In other embodiments a sacrificial scaffold may be formed by other methods, e.g., stereolithography, or injection molding. Parts formed by stereolithography, or injection molding, may also be stacked and/or bonded together before coating with the coating material. These methods may enable the fabrication of sacrificial scaffolds with tapered truss members and with nodes having enlarged cross-sectional areas, for the fabrication of heat exchanger cores with corresponding characteristics. The orientations of the individual tube cross sections may vary in a 3-dimensional array. Facesheets (for the formation of heat exchanger tubesheets) may be formed as part of the stereolithography, or injection molding process, or added subsequently, e.g., by bonding.

Heat exchangers according to embodiments of the present invention may be used for powertrain thermal management, climate control, turbocharger intercoolers, engine coolant radiators, and condenser, fan, radiator power train cooling modules (CRFMs) in general, oil coolers (both air-cooled and liquid-coolant-cooled), air conditioning condensers, air conditioning evaporators, environmental control system (ECS) air conditioning (AC) packs, precoolers, intercoolers, evaporators, or condensers.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the term "substantially," "about," and similar tears are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items means at least half of the items.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of present invention." Also, the term "exemplary" is intended to refer to an example or illustration.

As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on," "directly connected to", "directly coupled to", or "immediately adjacent to" another element or layer, there are no intervening elements or layers present.

Although exemplary embodiments of a louvered elliptical tube micro-lattice heat exchanger have been specifically described and illustrated herein, many modifications and variations will be apparent to those skilled in the art. Accordingly, it is to be understood that a louvered elliptical tube micro-lattice heat exchanger constructed according to principles of this invention may be embodied other than as specifically described herein. The invention is also defined in the following claims, and equivalents thereof.

What is claimed is:

1. A heat exchanger comprising a heat exchanger core, the heat exchanger core comprising:

a first plurality of hollow members extending in a first direction; and a second plurality of hollow members extending in a second direction different from the first direction, the hollow members of the first plurality of hollow members and the second plurality of hollow members intersecting at a plurality of hollow nodes, each hollow member of the first plurality of hollow members and the second plurality of hollow members having:

a length in a longitudinal axis, the length being a largest dimension of each respective one of the hollow members, and at a point along the length, an elongated cross section in a plane perpendicular to the longitudinal axis, the cross section comprising a smallest diameter in a direction parallel to a minor axis, the minor axis being perpendicular to the longitudinal axis, and a largest diameter in a direction parallel to a major axis, the major axis being perpendicular to the longitudinal axis, the minor axis and the major axis lying in the plane of the cross section, the largest diameter being at least 20 percent longer than the smallest diameter, and the largest diameter of a first one of the first plurality of hollow members extending in a different direction from the largest diameter of a second one of the first plurality of hollow members.

2. The heat exchanger of claim 1, wherein:

the heat exchanger core further comprises a third plurality of hollow members extending in a third direction different from the first direction and from the second direction;

the hollow members of the first plurality of hollow members, the second plurality of hollow members, and the third plurality of hollow members intersect at the plurality of hollow nodes; and each hollow member of the third plurality of hollow members has:

a length in a longitudinal axis, the length being a largest dimension of each respective one of the hollow members, and at a point along the length, an elongated cross section in a plane perpendicular to the longitudinal axis, the cross section comprising a smallest diameter in a direction parallel to a minor axis, the minor axis being perpendicular to the longitudinal axis, and a largest diameter in a direction parallel to a major axis, the major axis being perpendicular to the longitudinal axis, the minor axis and the major axis lying in the plane of the cross section, the largest diameter being at least 20 percent longer than the smallest diameter.

3. The heat exchanger of claim 2, wherein the elongated cross section of each hollow member of the first plurality of hollow members and the second plurality of hollow members is an elliptical cross section.

4. The heat exchanger of claim 2, wherein the elongated cross section of each hollow member of the first plurality of hollow members and the second plurality of hollow members has a shape of an airfoil.

5. The heat exchanger of claim 2, wherein the elongated cross section of each hollow member of the first plurality of hollow members and the second plurality of hollow members is a rectangular cross section with rounded corners.

6. The heat exchanger of claim 2, comprising an inlet and an outlet and having a principal external flow direction parallel to a line from the inlet to the outlet, wherein the core comprises:

a first region comprising hollow members of the first plurality of hollow members;

a second region comprising hollow members of the second plurality of hollow members; and a third region comprising hollow members of the third plurality of hollow members, the second region being between the first region and the third region, and wherein:

the major axis of each hollow member of the first region is parallel to the principal external flow direction, the major axis of each hollow member of the second region is oblique to the principal external flow direction, and the major axis of each hollow member of the third region is parallel to the principal external flow direction.

7. The heat exchanger of claim 2, comprising an inlet and an outlet and having a principal external flow direction parallel to a line from the inlet to the outlet, wherein the core comprises:

a first region comprising hollow members of the first plurality of hollow members;

a second region comprising hollow members of the second plurality of hollow members; and a third region comprising hollow members of the third plurality of hollow members, the second region being between the first region and the third region, and wherein:

the major axis of each hollow member of the first region is oblique to the principal external flow direction, the major axis of each hollow member of the second region is parallel to the principal external flow direction, and the major axis of each hollow member of the third region is oblique to the principal external flow direction.

8. The heat exchanger of claim 7, wherein:

the angle between the major axis of a hollow member of the first region and the principal external flow direction has the same magnitude as the angle between the major axis of a hollow member of the third region and the principal external flow direction.

9. The heat exchanger of claim 2, wherein the core has:

an interior core volume including an interior volume of each of:

the first plurality of hollow members;

the second plurality of hollow members; and the plurality of hollow nodes;

a first surface, the first surface being flat; and a second surface, the second surface being flat and parallel to the first surface, the heat exchanger further comprising a first tubesheet and a second tubesheet, each of the first tubesheet and the second tubesheet having a respective plurality of perforations in fluid communication with the interior core volume.

10. The heat exchanger of claim 9, wherein a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of:

a fifth plurality of hollow members being nearer than the first node to the first surface; and a sixth plurality of hollow members being nearer than the first node to the second surface;

a cross sectional area of the first hollow node being equal to the sum of cross sectional areas of the fifth plurality of hollow members.

11. The heat exchanger of claim 9, wherein a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of:

a fifth plurality of hollow members being nearer than the first node to the first surface; and a sixth plurality of hollow members being nearer than the first node to the second surface;

a cross sectional area of the first hollow node being within 15% of the sum of cross sectional areas of the fifth plurality of hollow members.

12. The heat exchanger of claim 9, wherein a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of:

a fifth plurality of hollow members being nearer than the first node to the first surface; and a sixth plurality of hollow members being nearer than the first node to the second surface;

a cross sectional area of the first hollow node being equal to the greater of:

the sum of cross sectional areas of the fifth plurality of hollow members and the sum of cross sectional areas of the sixth plurality of hollow members.

13. The heat exchanger of claim 9, wherein a first node of the plurality of hollow nodes defines a fourth plurality of hollow members of the first plurality of hollow members, the second plurality of hollow members, and the third plurality of hollow members, the fourth plurality of hollow members intersecting at the first node, the fourth plurality of hollow members consisting of:

a fifth plurality of hollow members being nearer than the first node to the first surface; and a sixth plurality of hollow members being nearer than the first node to the second surface;

a cross sectional area of the first hollow node being within 15% of the greater of:

the sum of cross sectional areas of the fifth plurality of hollow members and the sum of cross sectional areas of the sixth plurality of hollow members.

14. The heat exchanger of claim 2, wherein the hollow members of the first plurality of hollow members and the second plurality of hollow members comprise a plurality of dimples.

15. The heat exchanger of claim 14, wherein each of the dimples of the plurality of dimples has a non-circular cross section, taken on a plane tangent to a wall of a hollow member at the dimple.

16. The heat exchanger of claim 15, wherein the cross section of each of the dimples of the plurality of dimples, taken on a plane tangent to a wall of a hollow member at the dimple, has a major axis, and the major axis of the cross section of a first dimple of the plurality of dimples is oblique to the major axis of the cross section of a second dimple of the plurality of dimples.

17. The heat exchanger of claim 2, wherein a set of nodes of the plurality of nodes falls in a plane, and wherein a spacing between centers of adjacent nodes in a first direction in the plane is at least 30% greater than a spacing between centers of adjacent nodes in a second direction, perpendicular to the first direction, in the plane.

18. The heat exchanger of claim 1, wherein the major axis of the first one of the first plurality of hollow members is oblique to the major axis of the second one of the first plurality of hollow members.

19. The heat exchanger of claim 1, wherein the major axis of the first one of the first plurality of hollow members is perpendicular to the major axis of the second one of the first plurality of hollow members.

20. The heat exchanger of claim 1, wherein the first one of the first plurality of hollow members and the second one of the first plurality of hollow members are arranged in a louvered pattern.

* * * * *